United States Patent [19]

Chor

[11] 3,973,824

[45] Aug. 10, 1976

[54] MULTIPLE PENETRATION ALUMINUM CONNECTOR AND METHOD

[75] Inventor: Lawrence C. K. Chor, Woodbury, Minn.

[73] Assignee: Minnesota Mining and Manufacturing Company, St. Paul, Minn.

[22] Filed: Mar. 24, 1975

[21] Appl. No.: 561,027

[52] U.S. Cl. ..... 339/276 R; 29/628; 29/630 A; 174/84 C; 174/90; 339/276 T

[51] Int. Cl.[2] ..... H01R 5/00

[58] Field of Search ..... 29/628, 629, 630 R, 29/630 A; 339/276 R, 276 T; 174/84 C, 90, 94 R; 403/19, 20, 274, 275

[56] References Cited

UNITED STATES PATENTS

| | | | |
|---|---|---|---|
| 2,259,261 | 10/1941 | Miller et al. | 339/276 R |
| 2,375,480 | 5/1945 | Lee | 403/20 |
| 3,040,292 | 6/1962 | Bernard et al. | 29/630 A X |
| 3,184,817 | 5/1965 | Chesnais | 174/94 R UX |
| 3,500,296 | 3/1970 | O'Keefe et al. | 29/630 A X |
| 3,892,459 | 7/1975 | Dittman et al. | 339/95 R |

*Primary Examiner*—C.W. Lanham
*Assistant Examiner*—James R. Duzan
*Attorney, Agent, or Firm*—Alexander, Sell, Steldt & DeLaHunt

[57] ABSTRACT

An aluminum sleeve connector is applied to an aluminum conductor using multiple deep penetrations of the connector wall into the conductor. The penetrations are sufficient to at least fill the void volume between the connector and conductor in the transverse cross-section in which they lie. Each penetration causes plastic flow in the extruded material of the connector and in the conductor at their interface to minimize spring back and causes shearing at the interface to remove any oxide or other insulative coating.

14 Claims, 5 Drawing Figures

MULTIPLE PENETRATION ALUMINUM CONNECTOR AND METHOD

FIELD OF THE INVENTION

Figure 1:
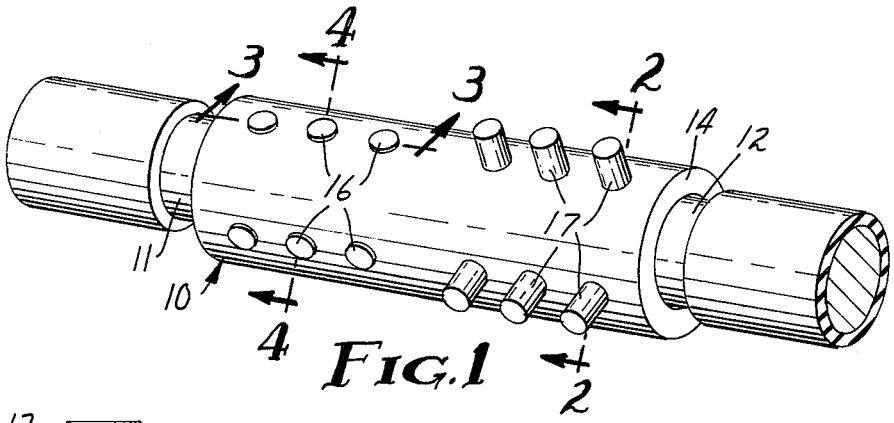

This invention relates to the connecting of aluminum electrical conductors.

BACKGROUND OF THE INVENTION

Mechanical connections for splicing or terminating electrical conductors, such as the common sleeve connector which is compressed or "crimped" onto the end of the conductor, have been the accepted standard of the electrical industry for many years. Such connections have the advantages of simplicity and economy and long use has proved their reliability on copper conductors.

The substitution of aluminum for copper conductors as carriers of electric current is now economically desirable. However, until now mechanical connections to aluminum conductors have been unreliable because aluminum has a greater tendency than copper to creep under continued stress and because a nonconductive oxide surface film rapidly forms on exposed aluminum. Thus, for example, crimped or coined connectors as described in U.S. Pat. No. 2,375,480 provide fully acceptable connections to copper conductors but have been found to produce unreliable connections to aluminum conductors.

SUMMARY OF THE INVENTION

In accordance with the present invention a connector having a sleeve with an internal cross-section close in shape and dimensions to the external cross-section of a specified aluminum conductor is applied to the conductor. The aluminum sleeve is placed on the aluminum conductor and the wall of the sleeve is penetrated with at least one hard pin to a depth of at least 80% but less than 130% of the wall thickness of the sleeve. The penetrations in a transverse cross-section around the sleeve are sufficient to fill the void volume between the sleeve and the conductor with material extruded from the sleeve. The penetrations cause plastic flow in the extruded material and the conductor at their interface to minimize spring back and they cause shearing at the interface to remove any oxide or other insulative coating.

Connections made in accordance with the present invention have been proven to be reliable on solid and stranded aluminum conductors through standard current cycling tests. They have also proven to have the further advantages of requiring substantially less force and total energy and less connector sleeve length than required to make a crimp connection.

THE DRAWING

Figure 2:
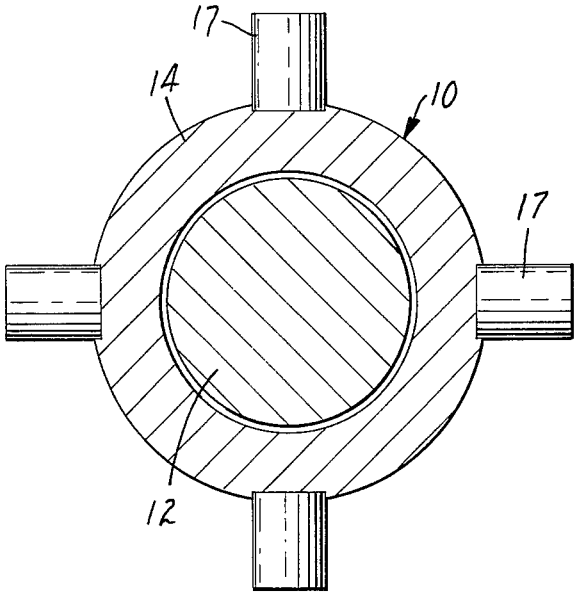
Figure 3:
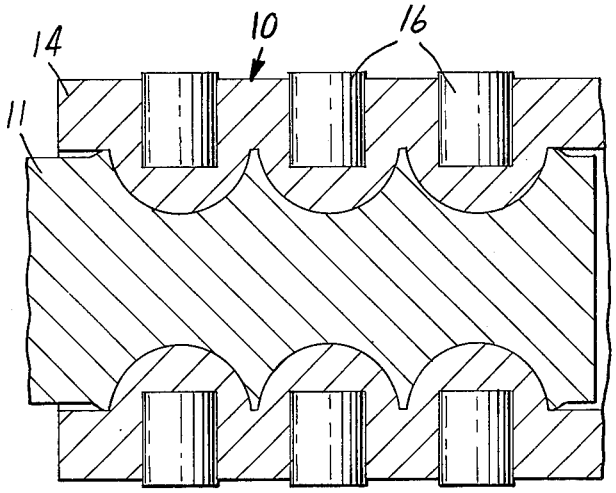
Figure 4:
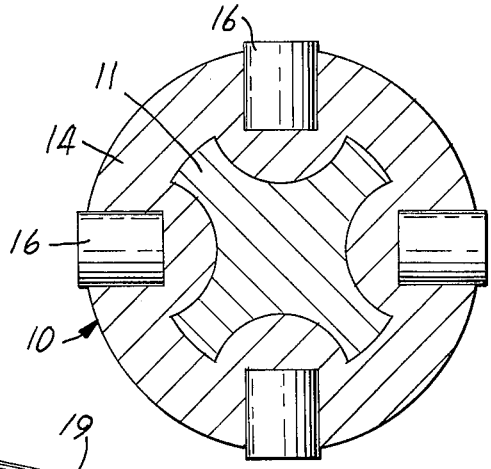
Figure 5:
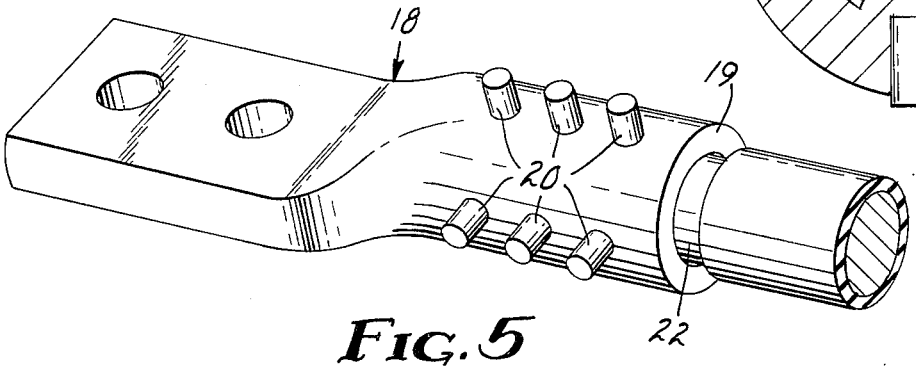

In the drawing:

FIG. 1 is a perspective view of a splice connector made in accordance with the present invention partially applied to connect two conductors in accordance with the method of the present invention;

FIGS. 2, 3 and 4 are cross-sectional views taken generally along lines 2—2, 3—3 and 4—4, respectively, of FIG. 1; and FIG. 5 is a perspective view of a terminal lug connector made in accordance with the present invention partially applied to a conductor end in accordance with the method of the present invention.

The connector 10 of FIGS. 1 through 4 is an inline connector for connecting the conductors 11 and 12. The connector 10 comprises a tubular aluminum sleeve 14 having an internal diameter close to the external diameter of the conductors 11 and 12 and a plurality of hard steel pins 16 and 17 retained on the sleeve 14. All of the pins initially extend generally radially (i.e. transversely) from the sleeve as do the pins 17 in FIGS. 1 and 2. The pins 16 and 17 have a prescribed diameter and length and are positioned in a prescribed manner for practicing the method of the present invention.

In accordance with the method of the present invention the connector 10 is placed on the ends of the conductors 11 and 12 and the pins 16 and 17 are pressed into the sleeve 14 to a position generally flush with the exterior of the sleeve as shown for the pins 16 in FIGS. 1, 3 and 4. The prescribed length of the pins 16 and 17 is at least 80% but less than 130% of the wall thickness of the sleeve 14 such that when pressed to a position generally flush with the exterior of the sleeve 14 they will penetrate the wall of the sleeve 14 to a depth of at least 80% but less than 130% of the wall thickness of the sleeve. The number and diameter of pins in each transverse cross-section around the sleeve 14 are chosen such that the volume of sleeve material under the pins is at least sufficient to fill the void volume between the sleeve and the conductor in that cross-section. Each penetration to the depth of at least 80% of the wall thickness of the sleeve causes plastic flow in the extruded material and the conductor at their interface to minimize spring back and to cause shearing at the interface to remove any oxide or other insulative coating. The limitation of the penetration depth to less than 130% of the wall-thickness of the sleeve 14 assures that the wall of the sleeve will not be ruptured by the penetration and thereby degrade the connection.

It has been found that by this method intimate electrical contact is initially made due to the removal of oxide or other insulative coating. Furthermore, the connection remains effective in use because (1) filling of the void volume between the sleeve 14 and the conductor 11 or 12 in each transverse cross-section causes hoop stress in the sleeve to create a residual resiliency in the sleeve forcing it into contact with the conductor, (2) plastic flow at the sleeve-conductor interface provides intimate contact and minimizes spring back of the sleeve material, thereby eliminating any even minute voids where oxidation would occur and insulate the conductor from the sleeve, and (3) the use of an aluminum sleeve on aluminum conductors assures that the thermal coefficient of expansion of the sleeve and the conductors will be at least very nearly the same thereby avoiding separtion of the connection and consequent oxidation with temperature cycling.

The above conditions of the method of the present invention are met for a transverse cross-section of penetrations around the sleeve 14 if the penetrations in that cross-section satisfy the following equation:

$$D^2-3[3\cdot PF\cdot WT]^{2/3}\cdot D^{4/3}+\frac{24}{KI}\left[\frac{(WD)^2\cdot(1+DT)^2}{4}-\frac{WCS}{\pi}\right]=0 \quad (1)$$

where:

$D$ is the penetrating pin diameter, $PF$ is the ratio of the pin penetration depth to the connector wall thickness and lies between 0.8 and 1.3 (i.e. the penetration depth is between 80% and 130% of the wall thickness of the sleeve for the reasons previously described), $WT$ is the wall thickness of the sleeve, $KI$ is the number of penetrations in the transverse cross-section, $WD$ is the conductor diameter, $DT$ is the inside diameter of the sleeve less the conductor diameter divided by the conductor diameter and lies between 0 and $2WT/WD$, and $WCS$ is the conductor cross-sectional area.

In equation (1) the variable to be solved for is the penetrating pin diameter, D, the pin penetration depth (i.e. the pin length) being set between 80% and 130% of the wall thickness of the sleeve. The only two independent variables are the conductor diameter, $WD$, and the conductor cross-sectional area, $WCS$, which are specified by the conductor on which the connector is to be used. The conductor diameter, $WD$, is the diameter as usually specified for solid and stranded cylindrical conductors and the conductor cross-sectional area, $WCS$, is $\pi(WD)^2/4$ for solid cylindrical conductor and is the sum of the cross-sectional areas of the strands in a stranded conductor, as is conventional.

The connector wall thickness, $WT$, in equation (1) can be analytically determined once the conductor size is chosen. That is, $WT$ is a function of $WD$ and $WCS$ only, according to the equation:

$$WT = \{[(WD)^2(1+DT)^2+4/\pi \cdot CF \cdot WCS]^{1/2} - WD(1+D\cdot T)\}^{1/2} \quad (2)$$

In equation (2) there are two parameters whose values must be chosen by the designer—

$DT$ — the clearance factor between the sleeve and the conductor, and $CF$ — the conductance factor.

The clearance factor, DT, which also appears in equation (1), is defined by the equation:

$$DT = \frac{BID-WD}{WD} \quad (3)$$

where $BID$ is the inside diameter of the sleeve. The only physical limits on $DT$ are that it must be greater than zero (i.e. the connector inside diameter must be greater than the conductor diameter) and it must be less than the ratio of two times the connector wall thickness to the conductor diameter. The upper limit provides the restraint that the total linear distance of the gap between the inner surface of the connector sleeve and the outer surface of the conductor must be less than two times the connector wall thickness in order to be able to fill the void volume. Thus, the limits on $DT$ are:

$$0 < DT = \frac{BID-WD}{WD} < \frac{2WT}{WD} \quad (4)$$

In practice, however, the range of $DT$ is much more limited based upon two basic engineering considerations. First, the connector sleeve must have enough clearance for an easy entrance of the conductors, especially for stranded conductors. Second, the clearance should not be overly large, otherwise the connector wall thickness must be increased to compensate for the unnecessary amount of clearance thereby unnecessarily increasing the cost of the connector. With these considerations in mind the clearance factor, $DT$, should generally range from 0.02 to 0.12. In general, the larger the conductor size the smaller the preferred value of $DT$.

The second factor in equation (2) that the designer must choose is the conductance factor, $CF$. The conductance factor is defined as the ratio of the cross-sectional area of the connector sleeve to the conductor cross-sectional area:

$$CF = \frac{\pi[BID \cdot WT+(WT)^2]}{WCS} \quad (5)$$

The conductance factor, $CF$, is chosen to make the cross-sectional area of the connector sleeve large enough to have electrical current conducting capability at least equal to that of the conductor to be connected. With the connector 10 of FIGS. 1 through 4 if both conductors 11 and 12 are aluminum $CF$ should thus be at least 1.0. However, if a connector like the connector 10 is constructed to splice an aluminum conductor to a copper conductor (the aluminum conductor and the connector on that side would normally be larger than the copper conductor and the connector on that side) $CF$ should be at least 1.7 on the copper side because copper has an electrical conductivity about 1.7 times that of aluminum. To continue the same area of the connection through which current will flow, the area of contact between the extruded sleeve material and the conductor must also be at least equal to the aluminum conductor cross-sectional area.

The remaining parameter appearing in equation (1) is the number of penetrations in a transverse cross-section, KI. The only physical limitation on the range of KI is that the quantity $KI \cdot$[the penetrating pin diameter, $D$, + desired spacing between two adjacent penetrations] is less than the outer circumference of the connector. In mathematical expression, the limitation on $KI$ is $$KI \leq \frac{\pi \cdot WD \cdot (1+DT)}{D \cdot SF} \quad (6)$$

where SF is the spacing factor defined as the ratio of the spacing between two adjacent penetrations to the pin diameter, $D$. Theoretically speaking, the center-to-center spacing, longitudinally or radially, between two adjacent penetrations should be at least two times the pin diameter (i.e. $SF \geq 2$) in order to have the plastic zones, or the dimples, developed by each penetration nonoverlapping. However, a more practical limit on SF is $SF \geq 1.5$.

With the above upper limit, $KI$ is arbitrarily selected and equation (1) is solved for the pin penetration diameter, $D$. The parameters necessary to make a good electrical connection in each transverse cross-section of penetrations around the sleeve are then known. If the arbitrary selection of $KI$ is too small, equation (1) cannot be solved because the void volume cannot be filled. Should this occur a larger value for $KI$ must be chosen and tried.

In addition to the desired electrical connection between the connector and the conductor as described above, the design of the connector must also account for the mechanical strength of the connection. This is most commonly defined as the resistance of the connection to a force tending to pull the conductor out of the connector, hereinafter referred to as the pullout strength.

After equation (1) has been solved to define each transverse cross-section of penetrations, the requirement of pullout strength is met when the number of transverse cross-sections of penetations satisfies the formula:

$$NR = \frac{B \cdot CS}{FPR} \tag{7}$$

wherein:

*NR* is the number of transverse cross-sections of penetrations,

*B* is the pullout factor which is specified in the industry by the location and type of connection made,

*CS* is the conductor breaking strength,

*FPR* is the pullout strength due to each transverse cross-section of penetrations, where:

$$B = \frac{\text{desired pullout force}}{CS}$$

and $$FPR = Y \cdot A_f \log_{10}\left[\frac{\pi \cdot (WD)^2}{4A_f}\right]$$

wherein:

*Y* is the yield strength of the conductor material $A_f$ is the conductor cross-sectional area under the penetrations where:

$$A_f = \frac{\pi}{4}(WD)^2 - \frac{KI}{8}\{(3 \cdot PF \cdot WT)^{2/3} \cdot D^{4/3}[\theta 1 - \mathrm{Sin}(\theta 1)] + (WD)^2[\theta 2 - \mathrm{Sin}\theta 2)]\}$$

$$\theta 1 = 2\tan^{-1}\left\{\left[\frac{1}{DT \cdot (DT+2)}\right]^{1/2}\right\}$$

$$\theta 2 = 2\tan^{-1}\left\{\frac{(3PF \cdot WT)^{1/3} \cdot D^{2/3}}{[(WD)^2(1+DT)^2 - (3PF \cdot WT)^{2/3} \cdot D^{4/3}]^{1/2}}\right\}$$

FIG. 5 illustrates an alternative embodiment of the connector of the present invention, a terminal lug connector 18. The lug 18 has an aluminum sleeve 19 with hard steel pins 20 retained thereon as described above with respect to the connector 10. The lug 18 is connected to an aluminum conductor 22 in the same manner as described above for the connector 10.

Within the scope of the method of the present invention, the hard pins 16, 17, 20 may be provided as part of a tool and thus not remain with the connector. Further, the pins when intended to remain with the connection may be retained on the connector sleeve in numerous ways, such as, for example, by being metallurgically or adhesively bonded to the sleeve or by being retained in a separate metal or elastomeric sleeve fitting over the connector sleeve. And, though convenient, it is not necessary that the pins be cylindrical for the equations given can be worked with a diameter which provides a cross-sectional area equivalent to the area of the pin used.

The present invention may also be utilized for connecting non-cylindrical conductors by providing a sleeve with an internal cross-section close in shape and dimensions to the external cross-section of the conductors. The equations provided would then normally be reworked for ease of application but if desired, they may be applied directly using a conductor diameter, *WD*, which provides a cross-sectional area equivalent to that of the conductor to be connected and in the equation for the clearance factor, *DT*, using the average spacing between the inside of the sleeve and outside of the conductor as (*BID*−*WD*).

Further, in accordance with the present invention, the aluminum sleeve may be provided in multiple pieces and joined around the conductors to be connected. In this manner a tap connection can readily be made.

Having thus described the present invention it will be understood that other modifications may be made without departing from the spirit and scope of the invention.

I claim:

1. A connector for a specified diameter aluminum conductor, comprising:

an aluminum sleeve with an internal cross-section close in shape and dimensions to the external cross-section of the conductor, and at least one head pin retained on said sleeve and extending generally transversely thereform, said pin having a length of at least 80% but less the 130% of the wall thickness of said sleeve, there being a sufficient number of pins retained in a transverse cross-section that the total volume of sleeve material under the pins is at least equal to the void volume between the sleeve and the conductor.

2. The connector of claim 1 wherein the coefficient of thermal expansion of said aluminum sleeve is generally the same as that of the conductor.

3. The connector of claim 1 wherein the pins retained on said sleeve in a transverse cross-section satisfy the formula:

$$D^2 - 3[3 \cdot PF \cdot WT]^{2/3} \cdot D^{4/3} + \frac{24}{KI}\left[\frac{(WD)^2 \cdot (1+DT)^2}{4} - \frac{WCS}{\pi}\right] = 0$$

where:

*D* is the pin diameter,

*PF* is the ratio of the pin length to the connector wall thickness and lies between 0.8 and 1.3,

*WT* is the wall thickness of the sleeve,

*KI* is the number of pins in the transverse cross-section,

*WD* is the conductor diameter,

*DT* is the inside diameter of the sleeve less the conductor diameter divided by the conductor diameter and lies between 0 and 2*WT*/*WD*, and

*WCS* is the conductor cross-sectional area.

4. The connector of claim 3 wherein *DT* is between 0.02 and 0.12.

5. The connector of claim 3 wherein:

$$WT = \tfrac{1}{2}\{[(WD)^2\cdot(1+DT)^2+4/\pi\cdot CF\cdot WCS]^{1/2} - WD\cdot(1+DT)\}$$

where:

*CF* is the conductance factor described by the formula:

$$CF = \frac{\pi[BID\cdot WT + (WT)^2]}{WCS} \geq 1$$

wherein:

*BID* is the inside diameter of the sleeve.

6. The connector of claim 3 wherein the number of transverse cross-sections of pins retained on said sleeve satisfies the formula:

$$NR = \frac{B\cdot CS}{FPR}$$

wherein:

*NR* is the number of transverse cross-sections of pins,

*B* is the pullout factor,

*CS*is the conductor breaking strength,

*FPR* is the pullout strength to be achieved by each transverse cross-section of pins where:

$$B = \frac{\text{desired pullout strength}}{CS}$$

and $$FPR = Y\cdot A_f \log_{10}\left[\frac{\pi\cdot(WD)^2}{4A_f}\right]$$

wherein:

*Y* is the yield strength of the conductor material $A_f$ is the conductor cross-sectional area under the pins wherein:

$$A_f = \frac{\pi}{4}(WD)^2 - \frac{KI}{8}\{(3\cdot PF\cdot WT)^{2/3}\cdot D^{4/3}[\theta 1 - \mathrm{Sin}(\theta 1)] + (WD)^2[\theta 2 - \mathrm{Sin}\theta 2)]\}$$

$$\theta 1 = 2\tan^{-1}\left\{\left[\frac{1}{DT\cdot(DT+2)}\right]^{1/2}\right\}$$

$$\theta 2 = 2\tan^{-1}\left\{\frac{(3PF\cdot WT)^{1/3}\cdot D^{2/3}}{[(WD)^2(1+DT)^2-(3PF\cdot WT)^{2/3}\cdot D^{4/3}]^{1/2}}\right\}$$

7. A method of applying a connector to an aluminum conductor comprising the steps of:

providing a connector having an aluminum sleeve with an internal cross-section close in shape and dimensions to the external cross-section of the conductor, placing the aluminum sleeve on the conductor, and penetrating the wall of the aluminum sleeve transversely with at least one hard pin to a depth of at least 80% but less than 130% of the wall thickness of the sleeve to extrude sufficient material of the sleeve to fill the void volume between the sleeve and the conductor in the transverse cross-section of the penetration, to cause plastic flow in the extruded material and the conductor at their interface to minimize spring back and to cause shearing at the interface to remove any oxide or other insulative coating.

8. The method of claim 7 including the step of similarly penetrating the wall of the aluminum sleeve in further transverse cross-sections sufficient to provide a predetermined pullout strength.

9. The method of claim 8 wherein said penetrations achieve an area of contact between the connector and conductor at least equal to the cross-sectional area of the conductor.

10. The method of claim 7 wherein the coefficient of expansion of the aluminum sleeve is generally the same as that of the conductor.

11. The method of claim 7 wherein the penetrations in a transverse cross-section satisfy the formula:

$$D^2 - 3[3\cdot PF\cdot WT]^{2/3}\cdot D^{4/3} + \frac{24}{KI}\left[\frac{(WD)^2\cdot(1+DT)^2}{4} - \frac{WCS}{\pi}\right] = 0$$

where:

*D* is the penetrating pin diameter,

*PF* is the ratio of the pin penetration depth to the connector wall thickness and lies between 0.8 and 1.3,

*WT* is the wall thickness of the sleeve,

*KI* is the number of penetrations in the transverse cross-section,

*WD* is the conductor diameter,

*DT* is the inside diameter of the sleeve less the conductor diameter divided by the conductor diameter and lies between 0 and 2*WT*/*WD*, and

*WCS* is the conductor cross-sectional area.

12. The method of claim 11 wherein *DT* is between 0.02 and 0.12.

13. The method of claim 11 wherein:

$$WT = \tfrac{1}{2}\{[WD)^2\cdot(1+DT)^2+4/\pi.CF\cdot WCS]^{1/2} - WD\cdot(1+DT)\}$$

where:

*CF* is the conductance factor described by the formula:

$$CF = \frac{\pi[BID\cdot WT + (WT)^2]}{WCS} \geq 1$$

wherein:

*BID* is the inside diameter of the sleeve.

14. The method of claim 5 wherein the number of transverse cross-sections of penetrations satisfies the formula:

$$NR = \frac{B\cdot CS}{FPR}$$

wherein:

*NR* is the number of transverse cross-sections of penetrations,

*B* is the pullout factor,

*CS* is the conductor breaking strength.

*FPR* is the pullout strength due to each transverse cross-section of penetrations where:

$$B = \frac{\text{desired pullout strength}}{CS}$$

and $$FPR = Y \cdot A_f \log_{10}\left[\frac{\pi (WD)^2}{4A_f}\right]$$

wherein:

$Y$ is the yield strength of the conductor material $A_f$ is the conductor cross-sectional area under the penetrations where:

$$A_f = \frac{\pi}{4}(WD)^2 - \frac{KI}{8}\left\{(3 \cdot PF \cdot WT)^{2/3} \cdot D^{4/3}[\theta 1 - \mathrm{Sin}(\theta 1)] + ((WD)^2[\theta 2 - \mathrm{Sin}\theta 2)]\right\}$$

$$\theta 1 = 2\tan^{-1}\left\{\left[\frac{1}{DT \cdot (DT+2)}\right]^{1/2}\right\}$$

$$\theta 2 = 2\tan^{-1}\left\{\frac{(3PF \cdot WT)^{1/3} \cdot D^{2/3}}{[(WD)^2(1+DT)^2 - (3PF \cdot WT)^{2/3} \cdot D^{4/3}]^{1/2}}\right\}.$$

* * * * *